United States Patent [19]

Ong et al.

[11] Patent Number: 5,043,240

[45] Date of Patent: Aug. 27, 1991

[54] ENCAPSULATED TONER COMPOSITIONS

[75] Inventors: Beng S. Ong, Mississauga; Guerino Sacripante, Cambridge, both of Canada

[73] Assignee: Xerox Corporation, Stamford, Conn.

[21] Appl. No.: 402,306

[22] Filed: Sep. 5, 1989

[51] Int. Cl.[5] ..... G03G 1/72; G03G 5/00; G03G 9/00

[52] U.S. Cl. ..... 430/109; 430/137; 430/138

[58] Field of Search ..... 430/138, 109, 137

[56] References Cited

U.S. PATENT DOCUMENTS

| | | | |
|---|---|---|---|
| 3,967,962 | 7/1976 | O'Malley | 430/120 |
| 3,974,078 | 8/1976 | Crystal | 430/109 |
| 4,442,194 | 4/1984 | Mikami | 430/137 |
| 4,465,755 | 8/1984 | Kiritani et al. | 430/111 |
| 4,468,446 | 8/1984 | Mikami et al. | 430/138 |
| 4,517,141 | 5/1985 | Dahm et al. | 464/4.7 |
| 4,520,091 | 5/1985 | Kakimi et al. | 430/110 |
| 4,565,764 | 1/1986 | Nakahara et al. | 430/111 |
| 4,590,142 | 5/1986 | Yamazaki et al. | 430/138 |
| 4,599,289 | 7/1986 | Suematsu et al. | 430/138 X |
| 4,601,967 | 7/1986 | Suzuki et al. | 430/107 |
| 4,610,945 | 9/1986 | Matsuoka et al. | 430/138 |
| 4,626,490 | 12/1986 | Yamazaki et al. | 430/138 |
| 4,642,281 | 2/1987 | Kakimi et al. | 430/138 |
| 4,740,443 | 4/1988 | Nakahara et al. | 430/106.6 |
| 4,797,344 | 1/1989 | Nakahara et al. | 430/138 |
| 4,803,144 | 2/1989 | Hosoi | 430/106.6 |

*Primary Examiner*—John Goodrow
*Assistant Examiner*—S. Crossan
*Attorney, Agent, or Firm*—E. O. Palazzo

[57] ABSTRACT

An encapsulated toner composition comprised of a core of a resin binder, pigment, dye, or mixtures thereof, and a polymeric shell containing a polyether component.

48 Claims, No Drawings

ENCAPSULATED TONER COMPOSITIONS

BACKGROUND OF THE INVENTION

The present invention is generally directed to toner compositions, and more specifically to encapsulated toner compositions. In one embodiment, the present invention relates to encapsulated toner compositions comprised of a core containing a binder resin, and colorants, including pigments, dyes, or mixtures thereof, and a polymeric shell thereover preferably prepared by interfacial polymerization. The polymeric shell contains a soft, flexible component such as a polyether moiety primarily for the purpose of improving the packing of the shell materials. Proper packing of the shell components permits, for example, a high density shell structure, and lowers, suppresses, or in some instance may eliminate the shell's permeability especially to the core binders. A high degree of shell permeability is primarily responsible for the leaching or bleeding of core binder from the toner, causing the problems of toner agglomeration or blocking, and image ghosting in imaging and printing processes, which problems are avoided or minimized with the toners of the present invention. A specific embodiment of the present invention relates to encapsulated toner compositions comprised of a core of binder resin and colorants, which core is encapsulated by a polymeric shell such as a polyurea, polyamide or polyester having incorporated within its structure a soft polyether or other similar component whereby there are enabled toners with the advantages illustrated herein including the absence or minimization of toner agglomeration, and the absence or minimization of image ghosting. Another specific embodiment of the present invention relates to an encapsulated pressure fixable toner composition wherein the shell is comprised of the reaction product of a polyisocyanate or polyisocyanates selected, for example, from the group consisting of benzene diisocyanate, toluene diisocyanate, diphenylmethane diisocyanate, polymethylene diisocyanate, other aromatic polyisocyanates, aliphatic isocyanates, and a diamine, or polyamines as illustrated in more detail hereinafter; and which shell further contains preferably in its structure a component, preferably a polyether or other soft structural moiety to, for example, prevent or minimize leaching or loss of the core components especially the core binder. In another embodiment of the present invention, the toner compositions obtained preferably include thereon an electroconductive material thereby enabling compositions with a controlled and stable volume resistivity such as, for example, from about $1\times10^3$ to about $1\times10^8$ ohm-cm, and preferably from about $5\times10^4$ and $5\times10^7$ ohm-cm, which toners are particularly useful for inductive development processes.

Examples of advantages associated with the toner compositions of the present invention are as indicated herein, and include the elimination and/or the minimization of image ghosting, excellent fixing characteristics, acceptable surface release properties, in some instances enabling their selection, for example, in imaging systems wherein a release fluid such as a silicone oil is avoided, substantially no toner agglomeration, acceptable powder flow characteristics, and minimal or no leaching of the core components. Also, the toners of the present invention possess the advantages of the ability to provide a substantially higher image fix to plain paper in some instances; a shell with substantially improved mechanical properties; and moreover, the shell monomers selected possess in many instances low vapor pressures, thus reducing environment hazards, which is not the situation with some of the prior art toner shells. Further, with the toner compositions of the present invention, the shell does not rupture prematurely causing the core component comprised, for example, of a polymer and magnetite, or other pigment to become exposed, which upon contact with other toner particles or toner development subsystem component surfaces and the like forms undesirable agglomerates. The excellent surface release properties possessed by the toners of the present invention provide for a complete or substantially complete transfer of toned images to a paper substrate during the development process, thus rendering this process very efficient. Furthermore, the toner compositions of the present invention can be obtained in high reaction yields in several embodiments thereof, and simple washing procedure to remove the coarse and fine particles can be selected to lower the manufacturing cost thereof. The toner compositions of the present invention can be selected for a variety of known reprographic imaging processes including electrophotographic and ionographic processes. Preferably the toner compositions of the present invention are selected for pressure fixing processes for ionographic printing wherein dielectric receivers, such as silicon carbide, are utilized, reference U.S. Pat. No. 4,885,220 entitled Amorphous Silicon Carbide Electroreceptors, the disclosure of which is totally incorporated herein by reference. Specifically, the toner compositions of the present invention can be selected for image development in commercial Delphax printers such as the Delphax S9000, S6000, S4500, S3000, and Xerox Corporation printers such as the 4060 TM and 4075 TM wherein, for example, transfixing is utilized, that is fixing of the developed image is accomplished by simultaneously transferring and fixing the developed images to a paper substrate with pressure. Another application of the toner compositions of the present invention is for two component development systems wherein, for example, the image toning and transfer are accomplished electrostatically, and the fixing of the transferred image is achieved by application of pressure, with or without the assistance of thermal energy.

The toner compositions of the present invention can, in one specific embodiment, be prepared by interfacial polymerization involving microcapsule shell-forming polycondensation, followed by an in situ core binder-forming free-radical polymerization of a core monomer or monomers in the presence of a free-radical initiator and suitable colorants. Thus, in one embodiment the present invention is directed to a process for a simple and economical preparation of pressure fixable encapsulated toner compositions by interfacial/free-radical polymerization methods wherein there are selected core monomers, pigments, and shell monomers, with at least one of the shell monomers containing a polyether segment therein, and a free radical initiator. Other process embodiments of the present invention relate to, for example, interfacial/free-radical polymerization methods for obtaining encapsulated colored toner compositions. Further, in another process aspect of the present invention the encapsulated toners can be prepared in the absence of solvents thus eliminating explosion hazards associated therewith; and furthermore, these processes do not require expensive and hazardous solvent separation and recovery steps. Moreover, with the process of the present invention there are obtained improved yields of toner products since, for example, the extraneous solvent component can be replaced by liquid core monomer(s). The toners prepared in accordance with the process of the present invention are useful for permitting the development of images in reprographic imaging systems, inclusive of electrostatographic and ionographic imaging processes wherein pressure fixing is selected, and for other imaging and printing processes.

The toner compositions of the present invention contain unique shell materials that permit the containment or substantial retention of the core components, thus eliminating or substantially suppressing core binder diffusion and leaching. As a consequence, the problems of toner agglomeration and image ghosting are completely or substantially eliminated. Furthermore, the toner compositions of the present invention dramatically improve the efficiency of the image transfer process to substrates such as paper in many embodiments. Also, with the toner compositions of the present invention, particularly with respect to their selection for single component inductive development processes, the toner particles contain on their surfaces a uniform and substantially permanently attached electroconductive material thereby imparting certain stable electroconductive characteristics to the particles inclusive of situations wherein these particles are subjected to vigorous agitation. With many of the prior art toners, the surface conductivity properties of the toner particles may be unstable when subjected to agitation, especially for example, when electroconductive dry surface additives such as carbon black are selected. Further, with the aforementioned prior art toner compositions there are usually obtained images of low quality with substantial background deposits, particularly after a number of imaging cycles, especially subsequent to vigorous mechanical agitation which results in toner electroconductivity instability since the additives such as carbon black are not permanently retained on the surface of the toner. Additionally, several of the cold pressure fixing toner compositions of the prior art have other disadvantages in that, for example, these compositions are obtained by processes which utilize organic solvents. The utilization of organic solvents renders the preparative process costly and potentially hazardous since most organic solvents are flammable and explosion-prone, and such processes also require expensive solvent separation and recovery steps. Moreover, the inclusion of solvents also decreases the toner throughput yield per unit volume of reactor size. Furthermore, with many of the prior art processes toners of narrow size dispersity cannot be easily achieved as contrasted with the process of the present invention where narrow particle size distributions are generally obtained. In addition, many prior art processes provide deleterious effects on toner particle morphology and bulk density as a result of the removal of solvent and the subsequent collapse or shrinkage of toner particles during the toner work-up and isolation processes resulting in a toner of very low bulk density. These disadvantages are substantially eliminated with the toners and processes of the present invention. More specifically, thus with the encapsulated toners of the present invention control of the toner physical properties of both the core and shell materials can be achieved. Specifically, with the encapsulated toners of the present invention undesirable leaching or loss of core components is avoided or minimized, and image ghosting is eliminated in many instances primarily in view of the presence of polyether functions in the shell material and the low permeability characteristics of the shell structure. Image ghosting is an undesirable phenomenon commonly encountered in ionographic printing when undesirable toner compositions are utilized. It refers to the repetitious printing of unwarranted images, and arises primarily from the contamination of the dielectric receiver by the unremovable toner materials. This problem can sometimes be partially eliminated by use of suitable surface release agents which aids in the removal of residual toner materials after image transfer. The toner compositions of the present invention eliminate or substantially eliminate the image ghosting problem by providing a microcapsule shell which effectively contains the core binder, inhibiting its leaching, and prevents it from coming into contact with the dielectric receiver during the image transfix process. In addition, the polyether component of the shell materials of the present invention also provides excellent surface release properties, thus enabling efficient removal of residual toner materials from the dielectric receiver surface. Furthermore, the excellent surface release properties afforded by the polyether-incorporated shell also dramatically enhances the image transfer efficiency of the transfix development processes.

Encapsulated cold pressure fixable toner compositions are known. Cold pressure fixable toners have a number of advantages in comparison to toners that are fused by heat, primarily relating to the utilization of less energy since the toner compositions selected can be fixed without application of heat. Nevertheless, many of the prior art cold pressure fixable toner compositions suffer from a number of deficiencies. For example, these toner compositions must usually be fixed under high pressure, which has a tendency to severely affect the fixing characteristics of the toner selected. This can result in images of low resolution or no images whatsoever. High pressure fixing also can result in unacceptable paper calendering. Also, with some of the prior art cold pressure toner compositions substantial image smearing can result from the high pressures used. Many of the prior art cold pressure fixable toner compositins, particularly those prepared by conventional melt blending processes, do not usually provide high image fix levels. Additionally, the cold pressure fixing toner compositions of the prior art have other disadvantages in that, for example, these compositions when fixed under high pressure provide, in some instances, images which are of high gloss and of low crease and rub resistance.

There were reported in a patentability search the following prior art, all U.S. Pat. Nos.: 3,967,962 which discloses a toner composition comprising a finely divided mixture comprising a colorant material and a polymeric material which is a block or graft copolymer, including apparently copolymers of polyurethane and a polyether (column 6), reference for example the Abstract of the Disclosure, and also note the disclosure in columns 2 and 3, 6 and 7, particularly lines 13 and 35; however, it does not appear that encapsulated toners are disclosed in this patent; U.S. Pat. No. 4,565,764 which discloses a microcapsule toner with a colored core material coated successively with a first resin wall and a second resin wall, reference for example the Abstract of the Disclosure and also note columns 2 to 7, and particularly column 7, beginning at line 31, wherein the first wall may comprise polyvinyl alcohol resins known in the art including polyurethanes, polyureas, and the like; U.S. Pat. No. 4,626,490 contains a similar teaching as the '764 patent and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; and U.S. patents of background interest include U.S. Pat. Nos. 4,442,194; 4,465,755; 4,520,091; 4,590,142; 4,610,945; 4,642,281; 4,740,443 and 4,803,144.

With further specific reference to the prior art, there are disclosed in U.S. Pat. No. 4,307,169, the disclosure of which is totally incorporated herein by reference, microcapsular electrostatic marking particles containing a pressure fixable core, and an encapsulating substance comprised of a pressure repturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there is disclosed in the prior art encapsulated toner compositions usually containing costly pigments and dyes, reference for example the color photocapsule toners of U.S. Pat. Nos. 4,399,209; 4,482,624; 4,483,912 and 4,397,483.

Interfacial polymerization processes are described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. Also, the shell-forming reaction disclosed in the aforementioned publication is initiated by heating the mixture to an elevated temperature at which point the isocyanate monomers are hydrolyzed at the interface to form amines, which then react with unhydrolyzed isocyanate monomers to enable the formation of a polyurea microcapsule wall. Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

Furthermore, other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, there are illustrated in U.S. Pat. No. 4,280,833 encapsulated materials prepared by interfacial polymerization in aqueous herbicidal compositions. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also of interest is the disclosure in column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art includes U.S. Pat. No. 4,520,091, the disclosure of which is totally incorporated herein by reference, which illustrates an encapsulated toner material wherein the shell can be formed by reacting a compound having an isocyanate with a polyamide, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamide to produce the shell, see column 4, line 34.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as polyvinyl pyrrolidone. Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1, and 2 thereof.

Illustrated in a U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, (now abandoned) the disclosure of which is totally incorporated herein by reference. In the aforementioned application, the core can be comprised of magnetite and a polyisobutylene of a specific molecular weight encapsulated in a polymeric shell material generated by an interfacial polymerization process.

There is a need for encapsulated toner compositions with many, and in some embodiments substantially, if not all, the advantages illustrated herein. More specifically, there is a need for encapsulated toners with shells that eliminate or minimize the loss of core components such as the binder resin. Also, there is a need for encapsulated toners wherein images with excellent resolution and superior fix are obtained. Moreover there is a need for encapsulated toners, including colored toners wherein image ghosting, toner offsetting, and undesirable leaching of core components and the like are avoided or minimized. Additionally, there is a need for encapsulated toners, including colored toners with, in some instances, excellent surface release characteristics enabling their selection in imaging systems without silicone oils and the costly apparatus associated therewith. Furthermore, there is a need for encapsulated toners, including colored toners, which exhibit no toner agglomeration thus providing a long toner shelf life exceeding, for example, one to two years, and wherein the core is encapsulated in a shell containing a soft polyether component therein. Also, there is a need for encapsulated toners that have been surface treated with additives such as carbon blacks, graphite or the like to render them conductive to a volume resistivity level of preferably from about $1\times10^3$ to $1\times10^8$ ohm-cm, and to enable their use in single component inductive development systems. Further, there is a need for encapsulated toners wherein surface additives such as metal salts or metal salts of fatty acids and the like are utilized to primarily assist in toner surface release properties. There is also a need for processes for the preparation of encapsulated toners with the advantages described hereinbefore. Specifically, there is a need for interfacial polymerization processes for black and colored encapsulated toner compositions, wherein the core contains a colorant or colorants, and a core binder derived from in situ free-radical polymerization of an addition-type monomer or monomers, which core is encapsulated in a microcapsule shell containing a polyether component. Furthermore, there is a need for toners and improved processes thereof that will enable the preparation of pressure fixable encapsulated toner compositions whose properties such as shell strength, core binder molecular weight and the nature of core binder crosslinking can be desirably controlled. Moreover, there is a need for enhanced flexibility in the design and selection of materials for the toner shell and core, and the control of the toner physical properties, such as bulk density, particle size, and size dispersity.

SUMMARY OF THE INVENTION

It is an object of the present invention to provide encapsulated toner compositions with many of the advantages illustrated herein.

It is also an object of the present invention to provide encapsulated toner compositions which provide desirable toner properties such as non-agglomeration, non-ghosting, high image fix, excellent image crease and rub resistance, low image gloss, and excellent image permanence characteristics.

In another object of the present invention there are provided encapsulated toner compositions comprised of a core of resin binder, colorants such as pigments or dyes, or mixtures thereof, and thereover a microcapsule shell prepared, for example, by interfacial polymerization which shell contains a soft component such as a polyether moiety to enable, for example, proper packing of shell material to reduce its permeability characteristics, and therefore eliminate or suppress the undesirable leaching or bleeding of core binder.

Another object of the present invention is the provision of encapsulated toners wherein image ghosting is eliminated in some embodiments, or minimized in other embodiments.

Further, another object of the present invention is the provision of encapsulated toners wherein toner agglomeration is eliminated in some embodiments, or minimized in other embodiments.

Also, another object of the present invention is the provision of encapsulated toners wherein core component leaching or loss is eliminated in some embodiments, or minimized in other embodiments.

Moreover, another object of the present invention is the provision of encapsulated toners wherein toner offsetting is eliminated in some embodiments, or minimized in other embodiments.

Additionally, another object of the present invention is the provision of encapsulated toners with extended shelf life.

Also, another object of the present invention is the provision of colored, that is other than black encapsulated toners.

It is another object of the present invention to provide encapsulated toners wherein the contamination of the imaging member, such as a dielectric receiver, including electroreceptors, is eliminated or minimized.

Another object of the present invention is the provision of encapsulated toners that can be selected for imaging processes, especially processes wherein pressure fixing is selected.

In another object of the present invention there are provided simple and economical preparative processes for black and colored toner compositions involving an interfacial shell-forming polymerization and an in situ free-radical core binder-forming polymerization whereby the shell formation, core binder formation, and the resulting toner material properties, can be independently and desirably controlled.

Another object of the present invention resides in the provision of simple and economical processes for black and colored pressure fixable toner compositions with durable, pressure-rupturable shells obtained by an interfacial/free-radical polymerization process.

Moreover, in a further object of the present invention there are provided processes for pressure fixable toner compositions wherein the core binders thereof are obtained via in situ free-radical polymerization of addition-type liquid monomers, which monomers also serve as a diluting vehicle and as a reaction medium for polymerization, thus eliminating the utilization of undesirable organic solvents in the process.

Another object of the present invention resides in the provision of processes for generating toner compositions with a relatively high bulk density of, for example, about 0.7 to about 1.2.

Moreover, in another object of the present invention there are provided improved microcapsule shells which contain, for example, a polyether component, thus enabling the production of high quality encapsulated toner compositions.

These and other objects of the present invention are accomplished by the provision of toners and, more specifically, encapsulated toners. In one embodiment of the present invention, there are provided encapsulated toners with a core comprised of a reson or polymer binder, pigment or dye; and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there is provided in accordance with the present invention encapsulated toners comprised of a core containing a polymer binder, pigment or dye particles, and thereover a shell preferably obtained by interfacial polymerization, which shell has incorporated therein a polyether structural moiety. Another specific embodiment of the present invention is directed to encapsulated toners comprised of a core of resin binder, pigment dye or mixtures thereof, and a polymeric shell of a polyether-incorporated polymer, such as poly(ether urea), a poly(ether amide), a poly(ether ester), a poly(ether urethane), mixtures thereof, and the like.

The aforementioned toners of the present invention can be prepared by an interfacial/free-radical polymerization process involving dispersing a mixture of core monomers, colorants, free-radical initiator, and one or more water-immiscible shell precursors into microdroplets in an aqueous medium containing a stabilizer. One of the shell precursors in this organic phase is a polyether-containing monomers or prepolymers. The nature and concentration of the stabilizer employed in the generation of stabilized microdroplets depend mainly, for example, on the toner components, the viscosity of the mixture, as well as on the desired toner particle size. The shell-forming interfacial polymerization is effected by addition of a water soluble shell monomer into the reaction medium. The water soluble shell monomer in the aqueous phase reacts with the water-immiscible shell precursors in the organic phase at the microdroplet/water interface resulting in the formation of a microcapsule shell around the microdroplet. The formation of core binder from the core monomers within the newly formed microcapsule is subsequently initiated by heating, thus completing the formation of an encapsulated toner of the present invention.

Illustrative examples of core monomers, which are subsequently polymerized, and are present in an effective amount of from, for example, about 10 to about 70 percent by weight include acrylates, methacrylates, olefins including styrene and its derivatives, such as styrene butadiene, and the like. Specific examples of core monomers, which are subsequently polymerized, include n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, dodecyl styrene, hexylmethyl styrene, nonyl styrene, tetradecyl styrene, other known addition monomers, reference for example U.S. Pat. No. 4,298,672, the disclosure of which is totally incorporated herein by reference, and mixtures thereof. Other similar core monomers not specifically recited may also be selected.

Various known pigments, present in the core in an effective amount of, for example, from about 2 to about 65 percent by weight, can be selected inclusive of carbon black, magnetites, such as Mobay magnetites MO8029, MO8060; Columbian Mapico Blacks and surface treated magnetites; Pfizer magnetites CB4799, CB5300, CB5600, MCX636; Bayer magnetites Bayferrox 8600, 8610; Northern Pigments magnetites, NP-604, NP-608; Magnox magnetites TMB-100 or TMB-104; and other similar black pigments, including mixtures of these pigments with the other colored pigments illustrated herein. As colored pigments there can be selected red, green, brown, blue, Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E.D. Toluidine Red and Bon Red C available from Dominion Color Corporation, Ltd., Toronto, Ontario, NOVAperm Yellow FGL, Hostaperm Pink E available from Hoechst, Cinquasia Magenta available from E.I. DuPont de Nemours & Company, and the like. Colored pigments that can be selected generally include cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy aceto-acetanilide, and Permanent Yellow FGL. The aforementioned pigments are incorporated into the microencapsulated toner compositions in various suitable effective amounts. In one embodiment, the pigment particles are present in the toner composition in an amount of from about 2 percent by weight to about 65 percent by weight calculated on the weight of the dry toner. Colored magnetites, which include mixtures of Mapico Black and cyan components may also be selected as pigments.

Examples of preferred shell polymers include polyureas, polyamides, polyesters, polyurethanes, mixtures thereof, and the like, which contain within their structures certain soft, flexible moieties such as polyether functions which, for example, assist in the molecular packing of the shell materials as well as imparting the desirable low surface energy characteristics to the shell structure. The shell amounts are generally from about 5 to about 30 percent by weight of the toner, and have a thickness generally, for example, of less than about 5 microns as indicated herein. Other shell polymers, shell amounts, and thicknesses may be selected.

In one embodiment of the present invention, the microcapsule shells are formed by interfacial polycondensation of one or more polyisocyanates, at least one of which is a polyether-based isocyanate such as the economical polyether isocyanate prepolymer, commercially available from Uniroyal Chemical and Mobay Chemical Corporation, in an organic phase with a polyamine or polyamines in an aqueous phase. Specific polyether isocyanates preferably include those with an NCO content of in excess of 5 percent by weight. Illustrative examples of polyether isocyanates include Uniroyal Chemical's diphenylmethane diisocyante-based liquid polyether vibrathanes such as B-635, B-843, and the like, and toluene diisocyanate-based liquid polyether Vibrathanes such as B-604, B-614, and the like, and Mobay's Chemical Corporation's liquid polyether isocyanate prepolymers, E-21 or E-21A (product code number D-716), 743 (product code numbers D-301), 744 (product code number D-302), and the like. Other polyisocyanates that can be selected as coreactants in an effective amount together with the polyether isocyanate for the formation of shell material are those available commercially including, for example, benzene diisocyanate, toluene diisocyanate, diphenylmethane diisocyanate, 1,6-hexamethylene diisocyanate, bis(4-isocyanatocyclohexyl)methane, MODUR CB-60, MONDUR CB-75, MONDUR MR, MONDUR MRS 10, PAPI 27, PAPI 135, Isonate 143L, Isonate 181, Isonate 125M, Isonate 191, and Isonate 240. Illustrative examples of polyamines suitable for the interfacial polycondensation shell formation include, for example, ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine. Generally, the shell polymer comprises from about 5 to about 30 percent by weight of the total toner composition, and preferably comprises from about 8 percent by weight to about 20 percent by weight of the toner composition. During the aforementioned interfacial polycondensation to form the shell, the temperature is maintained at from about 15° C. to about 55° C., and preferably from about 20° C. to about 30° C. Also, generally the reaction time is from about 5 minute to about 5 hours, and preferably from about 20 minutes to about 90 minutes. Other temperatures and times can be selected, and further polyisocyanates and polyamines not specifically illustrated may be selected.

Another embodiment of the present invention relates to encapsulated toners with a shell comprised of the polycondensation product of one or more, that is for example at least one, and preferably two polyisocyanates, at least one of which is a polyether isocyanate present in an effective amount, with a polyamine; and wherein the toner includes thereon an electroconductive material obtained from a water based dispersion of said electroconductive material in a polymeric binder, said polyether isocyanate being selected from the group consisting of Uniroyal Chemical's polyether Vibrathanes B-604, B-614, B-635, B-843, and Mobay Chemical Corporation's polyether isocyanate prepolymers E-21 or E-21A, XP-743, XP-744, and the like. The polyamine is selected, for example, from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene) triamine, tris(2-aminoethyl) amine, 4,4'-methylene bis(-cyclohexylamine), bis(3-aminopropyl)ethylene diamine, 1,3-bis(aminomethyl) cyclohexane, 1,5-diamino-2-methylpentane; and piperazine, 2-methylpiperazine, 2,5-dimethylpiperazine, 1,4-bis(3-aminopropyl) piperazine, and the like. Generally, the polyether isocyanate is selected in an amount of about 1 percent to 100 percent by weight of the total quantity of polyisocyanates used, and preferably in an amount of about 2 percent to about 20 percent by weight of the total quantity of polyisocyanates. Moreover, the polyether isocyanate should preferably have an NCO content of from about 1 percent to about 30 percent, and preferably from about 5 percent to about 20 percent by weight.

Other isocyanates may be selected for reaction with the polyamine to enable formation of the shell by interfacial polymerization, reference for example U.S. Pat. No. 4,612,272, and U.K. Patents 2,107,670 and 2,135,469, the disclosures of which are totally incorporated herein by reference.

Specific illustrative examples of commercially available polyether isocyanates that can be selected, many of which have been disclosed herein, include the polyether isocyanates B-604, B-614, B-635, B-843, E-21, E-21A, XP-743 and XP-744. Specific polyisocyanate coreactants for the shell-forming interfacial polymerization with the polyamines include benzene diisocyanate, toluene diisocyanate, diphenylmethane diisocyanate, 1,6-hexamethylene diisocyanate, bis(4-isocyanatocyclohexyl)-methane, MODUR CB-60, MONDUR CB-75, MONDUR MR, MONDUR MRS 10, PAPI 27, PAPI 135, Isonate 143L, Isonate 181, Isonate 125M, Isonate 191, and Isonate 240. Further, more than one coreactant in addition to the polyether isocyanate prepolymer may be employed. Illustrative specific examples of water soluble polyamine compounds, which are capable of interfacially polycondensing with the aforementioned isocyanates to form a durable microcapsule shell, include ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, 2-methylpiperazine, 2,5-dimethylpiperazine, 1,4-bis(3-aminopropyl)piperazine; and the like.

As a preferred shell material, there is selected the interfacial polycondensation product of a mixture of polyether isocyanate prepolymer E-21 or E-21A and Isonate 143L with 1,4-bis(3-aminopropyl)piperazine in the molar ratios of polyisocyanate to polyamine of from about 1:0.95 to 1:1.25, and preferably from about 1:1.03 to 1:1.10; the mole ratio of prepolymer E-21 or E-21A to Isonate 143L that can be employed is from about 0.005:0.995 to 0.50:0.50, and preferably from about 0.02:0.98 to 0.20:0.80.

Interfacial processes selected for the shell formation of the toners of the present invention are as illustrated, for example, in U.S. Pat. Nos. 4,000,087 and 4,307,169, the disclosures of which are totally incorporated herein by reference.

Surface additives can be selected for the toners of the present invention including, for example, metal salts, metal salts of fatty acids, colloidal silicas, mixtures thereof and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil R972.

The aforementioned toner compositions of the present invention can be prepared by a number of different processes as indicated herein including the interfacial/-free-radical polymerization process comprising mixing or blending of a core monomer or monomers, a mixture of reactive shell components, one of which is a polyether polyisocyanate, free-radical initiator, and colorants; dispersing this mixture of organic materials and colorants by high shear blending into stabilized microdroplets of specific droplet size and size distribution in an aqueous medium with the aid of suitable stabilizer or emulsifying agents wherein the average volume microdroplet diameter generally is from about 5 microns to about 30 microns, and the average volume droplet size dispersity generally is from about 1.2 to about 1.4 as inferred from the Coulter Counter measurements of the microcapsule particles after encapsulation; subsequently subjecting the aforementioned dispersion to a shell forming interfacial polycondensation by adding a water miscible polyamine; and thereafter, initiating the heat-induced free-radical polymerization for the formation of core binder within the newly formed microcapsules. The shell forming interfacial polycondensation is generally executed at ambient temperature, but elevated temperatures may also be employed depending on the nature and functionality of the shell components used. For the core binder-forming free-radical polymerization, it is generally accomplished at temperatures from ambient temperature to about 100° C., and preferably from ambient temperature to about 85° C. In addition, more than one initiator may be utilized to enhance the polymerization conversion, and to generate the desired molecular weight and molecular weight distribution.

Illustrative examples of free-radical initiators selected include azo compounds such as 2-2' azodimethylvaleronitrile, 2-2' azoisobutyronitrile, azobiscyclohexanenitrile, 2-methylbutyronitrile, or any mixtures thereof, and other similar known compounds, with the quantity of initiator(s) preferably being from about 0.5 percent to about 10 percent by weight of that of core monomer(s). Stabilizers selected include water soluble polymeric surfactants such as poly(vinyl alcohols), partially hydrolyzed poly(vinyl alcohols), hydroxypropyl cellulose, methyl cellulose, with a stabilizer to water ratio of from about 0.05 to about 0.75 for example.

The encapsulated toner compositions of the present invention are mechanically and thermally stable and possess acceptable shelf-life stability in most, if not all, embodiments thereof. For example, they do not suffer from premature rupture, and are nonblocking and nonagglomerating at temperatures up to 60° C. The polyether-incorporated shell materials of the present invention are robust and display a low degree of shell permeability to the core components, and in particular to the core binder resins. No leaching or bleeding of core components occur at storage for an extended period of time of over one to two years. In addition, the polyether incorporation into the shell structure also imparts the desirable good surface release as well as excellent powder flow properties to the resultant toner. The latter toner physical properties enable high image transfer efficiency and prevent image ghosting and offset during image development.

Also, the toner compositions can be rendered conductive with, for example, a volume resistivity value of from about $1\times10^3$ ohm-cm to about $1\times10^8$ ohm-cm by adding to the toner surface thereof components such as carbon blacks, graphite, and other conductive organometallic compounds. The aforementioned conductive toner compositions of the present invention are particularly useful for the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneous transferring and fixing by pressure onto paper with a toner transfer efficiency greater than 95 percent, and in many instances over 99 percent. The transfix pressure utilized for image fixing is generally less than 1,000 psi to about 4,000 psi, but preferably the transfix pressure is 2,000 psi to eliminate or alleviate the paper calendering and high image gloss problems. Examples of pressure fixing processes and systems that can be selected include those commercially available from Delphax, Hitachi, Cybernet, and others.

Further, the present invention is directed to methods for the development of images by, for example, forming by ion deposition on an electroreceptor, such as a polymer impregnated anodized aluminum oxide, a latent image, developing this image with the pressure fixable encapsulated toner compositions of the present invention, and subsequently simultaneously transferring and fixing the image to a suitable substrate such as paper.

For two component developers, carrier particles including steel ferrites, copper zinc ferrites, and the like with or without coatings can be admixed with the encapsulated toners of the present invention, reference for example the carriers illustrated in U.S. Pat. No. 4,937,166; U.S. Pat. No. 4,935,326; U.S. Pat. Nos. 4,560,635; 4,298,672; 3,839,029; 3,847,604; 3,849,182; 3,914,181; 3,929,657 and 4,042,518, the disclosures of which, including the copending applications, are totally incorporated herein by reference.

The following examples are being submitted to further define various species of the present invention. These examples are intended to be illustrative only and are not intended to limit the scope of the present invention.

EXAMPLE I

An 18.8 micron (average volume diameter) encapsulated toner with a poly(ether urea) shell derived from polyether isocyanate prepolymer E-21A and Isonate 143L, and a lauryl methacrylate magnetite core was prepared as follows:

A mixture of n-lauryl methacrylate (113 grams), 2,2'-azo-bis-(2,4-dimethyl-valeronitrile) (3.3 grams), 2,2'-azobis-(isobutyronitrile) (3.3 grams), Isonate 143L (42.2 grams), and Bayer's polyether isocyanate prepolymer E-21A (5.7 grams) was homogenized in a 2-liter Nalgene container with a Brinkmann polytron at 4,000 RPM for 30 seconds. To this mixture were then added the magnetite Bayferrox 8610 (300 grams) and dichloromethane (20 milliliters), and the corresponding slurry was homogenized at 8,000 RPM for three minutes. To the resulting mixture was added 1 liter, 0.10 percent (by weight), of an aqueous poly(vinyl alcohol) (88 percent hydrolyzed; MW 96,000) solution, and thereafter, the mixture was homogenized again at 9,000 RPM for 2 minutes. The resulting dispersion was transferred to a 2-liter reaction kettle immersed in an oil bath, and equipped with a mechanical stirrer. To the kettle contents were then added a solution of 37 milliliters of 1,4-bis(3-aminopropyl)piperazine in 80 milliliters of water, and the resulting mixture was allowed to react for one hour. Thereafter, the kettle was heated to 85° C. over a period of one hour, and polymerization was continued at this temperature for 6 hours before cooling down to room temperature. The resulting mixture was then transferred to a 4-liter beaker, and diluted with water to a volume of about four liters with constant stirring. The encapsulated toner particles were allowed to settle to the bottom of the beaker by gravity, and the aqueous supernatant was carefully decanted. The washing was repeated in this manner three times until the washing was clear. The washed toner was transferred to a 2-liter beaker and diluted with water to a total volume of 1.8 liter. Aquadag graphite E (23.5 grams, from Acheson Colloids), and water (100 milliliters) were then added, and the mixture was spray-dried in a Yamato Spray Dryer at an air inlet temperature of 160° C., and an air outlet temperature of 80° C. The air flow was retained at 0.75 $m^3$/minute, while the atomizing air pressure was retained at 1.0 killigram/$cm^2$. The collected dry encapsulated toner (360 grams) was screened through a 63 micron sieve; the toner's volume average particle diameter, as measured on a 256 channel Coulter Counter, was 18.8 microns with a volume average particle size dispersity of 1.36.

Two hundred and forty (240) grams of the above encapsulated toner A was dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM, to provide for the toner a volume resistivity of $1\times10^6$ ohm-cm. This toner is referred to as toner A.

A comparative toner B was prepared in accordance with the above procedure except that 118.7 grams of lauryl methacrylate were employed in place of 113 grams of the lauryl methacrylate and 5.7 grams of the polyether isocyanate prepolymer E-21A.

The pressure fixing ionographic printer selected for the testing of the toner compositions was the Delphax S-6000 printer. The developed images were transfixed at a pressure of 2,000 psi. Print quality was evaluated from a checkerboard print pattern. The image optical density was measured using a standard integrating densitometer. Image fix was measured by the standardized tape pull method wherein a tape was pressed with a uniform reproducible standard pressure against an image and then removed. The image fix level is expressed as a percentage of the retained image optical density after the tape test relative to the original image optical density. Image ghosting was evaluated qualitatively for over 2,000 prints. Toner shell integrity was judged qualitatively by observing any crushed or agglomerated toner on the hopper screen through which toner was fed to the machine magnetic roller. If crushed toner was found to adhere to and clog some of the screen openings after 2,000 copies, it was judged to have a premature toner rupture problem.

For encapsulated toner A, the image fix level was 92 percent with no image ghosting, and no toner agglomeration in the development housing for 2,000 prints. Furthermore, this toner did not display aggregation or agglomeration on standing, and no toner blocking was observed at 55° C. for 48 hours. For encapsulated toner B, the image fix level was 90 percent and severe image ghosting was observed after 100 prints. In addition, the toner B agglomerated on standing at room temperature for 10 days.

EXAMPLE II

A 19.5 micron encapsulated toner with a poly(ether urea) shell derived from a mixture of polyether isocyanate prepolymer E-21 and Isonate 143L with a core of lauryl methacrylate and magnetite was prepared as follows:

A mixture of n-lauryl methacrylate (132 grams), 2,2'-azo-bis-(2,4-dimethyl-valeronitrile) (2.6 grams), 2,2'-azobis-(isobutyronitrile) (2.6 grams), Isonate-143L (45.1 grams) magnetite and Bayer's polyether isocyanate prepolymer E-21 (1.7 grams) were homogenized in a 2-liter Nalgene container with a Brinkmann polytron at 4,000 RPM for 30 seconds. To this mixture were then added Northern Pigments magnetite NP-608 (208 grams) and dichloromethane (20 milliliters), and the corresponding slurry homogenized at 8,000 RPM for three minutes. To the resulting mixture was then added 1 liter, 0.10 percent (by weight), of an aqueous poly(vinyl alcohol) (88 percent hydrolyzed; MW 96,000) solution, and thereafter, the mixture was homogenized at 9,000 RPM for 2 minutes. The resulting dispersion was then transferred to a 2-liter reaction kettle immersed in an oil bath equipped with a mechanical stirrer. To the kettle contents was added a solution of 37 milliliters of 1,4-bis-(3-aminopropyl)piperazine in 80 milliliters of water, and the resulting mixture was then allowed to react for one hour. Thereafter, the reaction kettle was heated to 85° C. over a period of 1 hour and retained at this temperature for 5 hours before cooling to room temperature. The resulting reaction mixture was transferred to a 4-liter beaker, and was diluted to four liters with water under constant stirring conditions. The toner particles were allowed to settle to the bottom of the beaker by gravity, and the aqueous supernatant was carefully decanted. The aforementioned washing was repeated in this manner three times until the washing was clear. The washed encapsulated toner was transferred to a 2-liter beaker and diluted with water to a total volume of 1.8 liter. Aquadag E (23.5 grams, from Acheson Colloids) and water (100 milliliters) were then added to the beaker, and the resulting mixture was spray dried in a Yamato Spray Dryer at an air inlet temperature of 160° C., and an air outlet temperature of 80° C. The air flow was retained at 0.75 $m^3$/minute, while the atomizing air pressure was retained at 1.0 killigram/$cm^2$. The collected encapsulated dry toner (360 grams) was screened through a 63 microns sieve; the toner's volume average particle diameter, as measured on a 256 channel Coulter Counter, was 19.5 microns with a volume average particle size dispersity of 1.33.

Two hundred and forty (240) grams of the encapsulated dry toner was dry blended using a Greey blender, first with 0.96 gram of carbon black (Black Pearls 2000) for 2 minutes with the the blending impeller operating at 3,500 RPM, and then with 3.6 grams of zinc stearate for another 10 minutes at the impeller speed of 3,000 RPM, to provide a volume resistivity of $8\times10^5$ ohm-cm. This toner, referred to as toner C, displayed an excellent resistance to agglomeration on standing, and did not block at 55° C. for 48 hours.

An encapsulated toner D, prepared for comparative purposes, was obtained in accordance with the above procedure except that 133.7 grams of n-lauryl methacrylate were utilized instead of 132 grams of lauryl methacrylate, and instead of 1.7 grams of polyether isocyanate prepolymer E-21. This toner exhibited a tendency to agglomerate within 1 week on standing room temperature.

Machine testing of these toners was accomplished in accordance with the procedure of Example I. For toner C, the image fix level was 86 percent, and no image ghosting was observed after 2,000 prints. Furthermore, no toner agglomeration was detected in the development housing of the printer. In contrast, toner D provided an image fix level of 83 percent with observable image ghosting after two to three prints, and severe image ghosting after 100 prints.

EXAMPLE III

A 19.1 micron encapsulated toner with a poly(ether urea) shell derived from a mixture of polyether isocyanate prepolymer XP-744 and Isonate 143 L, and a core of lauryl methacrylate and magnetite was prepared as follows:

A mixture of n-lauryl methacrylate (132 grams),2,2'-azo-bis(2,4-dimethyl-valeronitrile) (2.6 grams), 2,2'-azo-bis-(isobutyronitrile) (2.6 grams), Isonate-143 L (42.2 grams), and Bayer's polyether isocyanate prepolymer XP-744 (5.7 grams) was homogenized in a 2-liter Nalgene container with a Brinkmann polytron at 4,000 RPM for 30 seconds. To this mixture were added Columbian Chemical Mapico Black magnetite (280 grams) and dichloromethane (20 milliliters), and the corresponding slurry was homogenized at 8,000 RPM for three minutes. To the mixture was then added 1 liter, 0.10 percent (by weight), of an aqueous poly(vinyl alcohol) (88 percent hydrolyzed; MW 96,000) solution, and thereafter, the mixture was homogenized at 9,000 RPM for 2 minutes. The resulting dispersion was transferred to a 2-liter reaction kettle immersed in an oil bath and equipped with a mechanical stirrer. To the kettle contents was then added a solution of 37 milliliters of 1,4-bis-(3-aminopropyl)piperazine in 80 milliliters of water, and the resulting mixture was allowed to react for one hour. Thereafter, the kettle was heated to 85° C. over a period of 1 hour, and was maintained at this temperature for another 5 hours before cooling to room temperature. The resulting reaction mixture was transferred to a 4-liter beaker, and washed by diluting with water to a volume of four liters with constant stirring. The toner particles were allowed to settle to the bottom of the beaker by gravity, and the aqueous supernatant was decanted. The aforementioned washing was repeated in this manner three times until the washing was clear. The wet encapsulated toner was transferred to a 2-liter beaker and diluted with water to a total volume of 1.8 liters. Aquadag graphite E (23.5 grams, from Acheson Colloids) and water (100 milliliters) were added to the beaker, and the resulting mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 killigram/$cm^2$. The collected dry toner (360 grams) was screened through a 63 micron sieve; the toner's volume average particle diameter was measured to be 19.1 microns with a volume average particle size dispersity of 1.32.

Two hundred and forty (240) grams of the above encapsulated toner was dry-blended using a Greey blender, first with 0.96 grams of carbon black (Black Pearls 2000) for 2 minutes with the blending impeller operating at 3,500 RPM, and then with 3.6 grams of zinc stearate for another 10 minutes at the impeller speed of 3,000 RPM, to provide a toner resistivity of $9\times10^5$ ohm-cm. This toner displayed no agglomeration on standing, and provided an image fix level of 78 percent without image ghosting for 2,000 prints.

A comparative encapsulated toner was prepared in accordance with the above procedure except that 137.7 grams of n-lauryl methacrylate was utilized in place of 135 grams of n-lauryl methacrylate, and in place of the 5.7 grams of polyether isocyanate prepolymer XP-744. This toner agglomerated within 8 days on standing at room temperature, andhad an image fix level of 83 percent with severe image ghosting after 30 prints.

EXAMPLE IV

A 20.5 micron encapsulated toner comprising a poly(ether urea) shell derived from polyether isocyanate prepolymer E-21 and Isonate 143L was prepared as follows.

A toner was prepared in accordance with the procedure of Example I with a mixture of n-lauryl methacrylate (113 grams), 2,2'-azo-bis-(2,4-dimethyl-valeronitrile) (3.3 grams), 2,2'-azobis-(isobutyronitrile) (3.3 grams), Isonate-143L (42.2 grams), polyether isocyanate prepolymer E-21 (5.7 grams), and Magnox TMB-100 (300 grams) in place of a mixture of n-lauryl methacrylate (132 grams), 2,2'-azo-bis(2,4-dimethyl-valeronitrile) (2.6 grams), 2,2'-azobis-(isobutyronitrile) (2.6 grams), Isonate 143L (45.1 grams), polyether isocyanate prepolymer E-21 (1.7 grams), and Northern Pigments NP-608 (280 grams). Three hundred and sixty (360) grams of the above prepared encapsulated dry toner with a volume average particle diameter of 20.5 microns and a volume average particle size dispersity of 1.36 were obtained. This toner did not exhibit toner agglomeration, and was stable at 55° C. for 48 hours. Also, this encapsulated toner provided an image fix level of 85 percent in the Delphax S-6000 testing printing machine with no observable image ghosting for 2,000 prints.

EXAMPLE V

A 17.2 micron encapsulated toner comprising a poly(ether urea) shell derived from polyether Vibrathane and Isonate 143L with a core binder resin of lauryl methacrylate-stearyl methacrylate copolymer was prepared as follows.

The toner was prepared in accordance with the procedure of Example I with the exceptions that a mixture of n-lauryl methacrylate (56.5 grams), stearyl methacrylate (56.5 grams), 2,2'-azo-bis-(2,4-dimethyl-valeronitrile) (3.3 grams), 2,2'-azobis-(isobutyronitrile) (3.3 grams), Isonate 143L (42.2 grams), polyether Vibrathane with a 16 percent NCO content (5.7 grams), and Northern Pigments NP-604 (300 grams) was employed in place of the mixture of n-lauryl methacrylate (132 grams), 2,2'-azo-bis-(2,4-dimethyl-valeronitrile) (2.6 grams), 2,2'-azobis-(isobutyronitrile) (2.6 grams), Isonate 143L (45.1 grams), polyether isocyanate prepolymer E-21 (1.7 grams), and Northern Pigments NP-608 (280 grams). In addition, 0.12 percent instead of 0.10 percent of the aqueous poly(vinyl alcohol) solution was utilized to generate a smaller toner particle size, and the toner preparation was accomplished without the use of dichloromethane. Three hundred and seventy-three (373) grams of dry encapsulated toner with a volume average particle diameter of 17.2 microns and a volume average particle size dispersity of 1.31 were obtained. The toner exhibited no signs of agglomeration even at a temperature of 55° C. for 48 hours. Also, this toner was machine tested in accordance with the procedure of Example I, and substantially similar results were obtained.

EXAMPLE VI

A 15.9 micron encapsulated toner with a poly(ether urea) shell derived from polyether Vibrathane B-670 and Isonate 143L was prepared in accordance with the procedure of Example I except that a mixture of n-lauryl methacrylate (100.0 grams), n-butyl methacrylate (13.0 grams), 2,2'-azo-bis-(2,4-dimethyl-valeronitrile) (3.3 grams), 2,2'-azobis-(isobutyronitrile) (3.3 grams), Isonate 143L (42.2 grams), polyether Vibrathane B-670 (6.0 grams), and Pfizer MCX6368 (280 grams) was employed in place of a mixture of n-lauryl methacrylate (132 grams), 2,2'-azo-bis-(2,4-dimethyl-valeronitrile) (2.6 grams), 2,2'-azobis-(isobutyronitrile) (2.6 grams), Isonate 143L (45.1 grams), polyether isocyanate prepolymer E-21 (1.7 grams), and Northern Pigments NP-608 (280 grams). In addition, 0.14 percent instead of 0.10 percent of the aqueous poly(vinyl alcohol) solution was utilized for the preparation. Three hundred and sixty-eight (368) grams of an encapsulated dry toner with a volume average particle diameter of 15.9 microns and a volume average particle size dispersity of 1.35 were obtained. The toner exhibited no signs of agglomeration, and provided an image fix level of 78 percent with no image ghosting for 2,000 prints when tested in accordance with the procedure of Example I.

EXAMPLE VII

A 16.3 micron encapsulated toner with a poly(ether urea) shell derived from polyether Vibrathane was prepared in accordance with the procedure of Example VI using a mixture of butyl acrylate (core binder after polymerization) (115 grams), polyether Vibrathane B-843 (5.5 grams), and Magnox TMB-104 (300 grams) in place of a mixture of n-lauryl methacrylate (100.0 grams), butyl methacrylate (13.0 grams), polyether Vibrathane B-670 (6.0 grams), and Pfizer MCX6368 (280 grams). Three hundred and seventy-one (371) grams of an encapsulated dry toner with a volume average particle diameter of 16.3 microns and a volume average particle size dispersity of 1.36 were obtained. The toner exhibited no agglomeration, and provided an image fix level of 75 percent with no image ghosting for 2,000 prints when tested in accordance with the procedure of Example I.

EXAMPLE VIII

A 15.3 micron encapsulated toner with a poly(ether urea) shell derived from polyether isocyanate prepolymer E-21 and polyether Vibrathane B-604 was prepared in accordance with the procedure of Example I using a mixture of n-lauryl methacrylate (100.0 grams), stearyl methacrylate (13.0 grams), 2,2'-azo-bis-(2,4-dimethyl-valeronitrile) (3.3 grams), 2,2'-azobis-(isobutyronitrile) (3.3 grams), Isonate 143L (42.2 grams), polyether isocyanate prepolymer E-21 (2.5 grams), polyether Vibrathane B-604 (2.5 grams), Bayferrox 8610 (150 grams), and Northern Pigments NP-608 (150 grams) in place of a mixture of n-lauryl methacrylate (132 grams), 2,2'-azo-bis-(2,4-dimethyl-valeronitrile) (2.6 grams), 2,2'azobis-(isobutyronitrile) (2.6 grams), Isonate 143L (45.1 grams), polyether isocyanate prepolymer E-21 (1.7 grams), and Northern Pigments NP-608 (280 grams). In addition, 0.15 percent instead of 0.10 percent of the aqueous poly(vinyl alcohol) solution was utilized for the preparation. Three hundred and sixty (360) grams of encapsulated dry toner with a volume average particle diameter of 15.3 microns and a volume average particle size dispersity of 1.34 were obtained, and wherein the binder contained n-styrene lauryl methacrylate stearyl methacrylate copolymer. This toner exhibited no signs of agglomeration, and provided an image fix level of 88 percent with no image ghosting for 2,000 prints in the Delphax printer when tested in accordance with the procedure of Example I.

EXAMPLE IX

An 18.1 micron encapsulated toner with a poly(ether urea) shell derived from polyether isocyanate prepolymer was prepared in accordance with the procedure of Example I using a mixture of n-lauryl methacrylate (93.0 grams), 2-ethoxyethyl methacrylate (20.0 grams), 2,2'-azo-bis-(2,4-dimethyl-valeronitrile) (3.3 grams), 2,2'-azobis-(isobutyronitrile) (3.3 grams), Isonate 143L (42.2 grams), polyether isocyanate prepolymer E-21 (5.7 grams), Mapico Black (80 grams), and NP-608 (200 grams) in place of a mixture of n-lauryl methacrylate (132 grams), 2,2'-azo-bis-(2,4-dimethyl-valeronitrile) (2.6 grams), 2,2'-azobis-(isobutyronitrile) (2.6 grams), Isonate 143L (45.1 grams), polyether isocyanate prepolymer E-21 (1.7 grams), and NP-608 (280 grams). In addition, 0.12 percent instead of 0.10 percent of the aqueous poly(vinyl alcohol) solution was employed for the preparation. Three hundred and seventy-two (372)

grams of dry toner with a volume average particle diameter of 18.1 microns and a volume average particle size dispersity of 1.37 were obtained. The toner exhibited no signs of agglomeration, and provided an image fix level of 82 percent with no image ghosting for 2,000 prints in the Delphax printer when tested in accordance with the procedure of Example I.

Other modifications of the present invention may occur to those skilled in the art subsequent to a review of the present application, and these modifications, including equivalents thereof, are intended to be included within the scope of the present invention.

What is claimed is:

1. An encapsulated toner composition comprised of a core comprised of a resin binder, pigment, dye, or mixtures thereof, and a polymeric shell selected from the group consisting of a polyurea, a polyamide, a polyester, and mixtures thereof containing a polyether component.

2. A toner in accordance with claim 1 wherein the polymeric shell contains therein as an integral part thereof a polyether component selected from the group consisting of a poly(ether urea), a poly(ether urethane), a poly(ether amide), a poly(ether ester), or mixtures thereof.

3. A toner in accordance with claim 1 wherein the polymeric shell contains therein as an integral part thereof a polyether component and wherein the entire shell is comprised substantially of the polyether component selected from the group consisting of a poly(ether urea), a poly(ether urethane), a poly(ether ester), a poly(ether amide), or mixtures thereof.

4. A toner in accordance with claim 1 wherein the core resin binder is an acrylate polymer, a methacrylate polymer, or styrene polymer.

5. A toner in accordance with claim 1 wherein the core resin binder is a dodecyl styrene polymer.

6. A toner in accordance with claim 1 wherein the core resin binder is selected from the group consisting of acrylate copolymers, methacrylate copolymers, styrene and dodecyl styrene copolymers.

7. A toner in accordance with claim 1 wherein the core resin binder is comprised of poly(butyl acrylate), poly(butyl methacrylate), poly(decyl methacrylate), poly(lauryl acrylate), poly(lauryl methacrylate), poly(hexyl acrylate), poly(hexyl methacrylate), poly(propyl acrylate), poly(propyl methacrylate), poly(benzyl acrylate), poly(benzyl methacrylate), poly(pentyl acrylate), poly(pentyl methacrylate), poly(cyclohexyl acrylate), poly(cyclohexyl methacrylate), poly(ethoxypropyl acrylate), poly(ethoxypropyl methacrylate), poly(methoxybutyl acrylate), poly(cyanobutyl acrylate), poly(heptyl acrylate), poly(heptyl methacrylate), poly(methylbutyl acrylate), poly(methylbutyl methacrylate), poly(octyl acrylate), poly(octyl methacrylate), poly(ethylhexyl methacrylate), poly(mtolyl acrylate), poly(dodecyl styrene), poly(hexylmethyl styrene), poly(nonyl styrene), poly(tetradecyl styrene), or the copolymers thereof.

8. A toner composition in accordance with claim 7 wherein the shell material contains a polyurea, a polyester, a polyamide, a polyurethane, or mixtures thereof.

9. A toner in accordance with claim 1 wherein the pigment is carbon black, magnetite, or mixtures thereof.

10. A toner in accordance with claim 9 wherein the magnetite selected is Mapico Black or surface treated magnetites.

11. A toner in accordance with claim 1 wherein the pigment is cyan, yellow, magenta, red, green, blue, brown, or mixtures thereof.

12. A toner in accordance with claim 1 wherein the pigment is Heliogen Blue, Pylam Oil Blue, Pylam Oil Yellow, Pigment Blue 1, Pigment Violet 1, Pigment Red, Lemon Chrome Yellow, E.D. Toluidine Red, Bon Red C, NOVAperm Yellow FGL, Hostaperm Pink E, Cinquasia Magenta, Oil Red anthraquinone dye, Cl Dispersed Red 15, diazo dye, Cl Solvent Red 19, copper tetra-4-(octadecyl sulfonamido) phthalocyanine, X-copper phthalocyanine pigment, Cl Pigment Blue, Anthrathrene Blue, diarylide yellow 3,3-dichlorobenzidene acetoacetanilides, Cl Solvent Yellow, a nitrophenyl amine sulfonamide, Cl Dispersed Yellow 33, 2,5-dimethoxy-4-sulfonanilide phenylazo-4'-chloro-2,5-dimethoxy aceto-acetanilide, or Permanent Yellow FGL.

13. A toner in accordance with claim 1 wherein the polymeric shell represents from 5 percent to 30 percent by weight of toner, the core binder resin represents from 20 percent to 93 percent by weight of toner, and the pigment or dye represents from 2 percent to 75 percent by weight of toner.

14. A toner in accordance with claim 1 containing surface additives.

15. A toner in accordance with claim 14 wherein the surface additives are metal salts, metal salts of fatty acids, or colloidal silicas.

16. A toner in accordance with claim 15 wherein zinc stearate is selected.

17. A toner in accordance with claim 14 wherein the additives are present in an amount of from about 0.1 to about 3 weight percent.

18. A toner in accordance with claim 17 wherein the shell contains a poly(ether urea) material.

19. A toner in accordance with claim 1 wherein the shell is prepared by interfacial polymerization.

20. A toner in accordance with claim 1 wherein the polymeric shell is comprised of the interfacial polycondensation product of at least one polyisocyanate, at least one of which is a polyether-based polyisocyanate, and a polyamine.

21. A toner in accordance with claim 20 wherein the polyether-based polyisocyanate is selected for the interfacial polycondensation reaction in an amount of from about 0.5 percent to about 90 percent by weight of the total polyisocyanate selected.

22. A toner in accordance with claim 20 wherein the polyether-based polyisocyanate is employed in the interfacial polycondensation reaction in an amount of from about 1 percent to about 20 percent by weight of the total polyisocyanates selected.

23. A toner in accordance with claim 22 wherein one of the polyisocyanate coreactants is selected from the group consisting of benzene diisocyanate, toluene diisocyanate, diphenylmethane diisocyanate, 1,6-hexamethylene diisocyanate, bis(4-isocyanatocyclohexyl)methane, MODUR CB-60, MONDUR CB-75, MONDUR MR, MONDUR MRS 10, PAPI 27, PAPI 135, PAPI 94, PAPI 901, Isonate 143L, Isonate 181, Isonate 125M, Isonate 191, and Isonate 240; and the polyamine component is selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, and 1,4-bis(3-aminopropyl)piperazine.

24. A toner in accordance with claim 23 wherein the conductive components are comprised of carbon black, graphite, or mixtures thereof.

25. A toner in accordance with claim 20 wherein the polyetherbased polyisocyanate is selected from the group consisting of polyether Vibrathanes, and polyether isocyanate prepolymers.

26. A toner in accordance with claim 20 wherein a plurality of polyisocyanates is selected.

27. A toner composition in accordance with claim 26 wherein two polyisocyanates are selected.

28. A toner composition in accordance with claim 26 wherein an aliphatic or aromatic polyisocyanate is selected.

29. A toner in accordance with claim 1 wherein the polymeric shell contains conductive components.

30. A toner composition in accordance with claim 29 wherein the resistivity thereof is from about $10^3$ to about $10^8$ ohm-cm.

31. A toner composition in accordance with claim 29 wherein the resistivity is achieved at 10 volts.

32. A method of imaging which comprises forming by ion deposition on an electroreceptor a latent image, subsequently developing this image with the toner composition of claim 1, and thereafter transferring and fixing the image to a suitable substrate.

33. A method of imaging in accordance with claim 32 wherein there results images with excellent image fixing characteristics.

34. A method of imaging in accordance with claim 32 wherein fixing is accomplished at pressures of from about 500 psi to about 6,000 psi.

35. A toner composition in accordance with claim 1 wherein the shell material is comprised of a poly(ether urea), a poly(ether amide), a poly(ether urethane), a poly(ether ester) and mixtures thereof.

36. A toner composition in accordance with claim 1 wherein the polymeric shell is comprised of a polyurea, a polyamide, a polyurethane, or mixtures thereof, which shell contains a poly(ether urea), a poly(ether urethane), a poly(ether amide), a poly(ether ester) or mixtures thereof.

37. A toner composition in accordance with claim 1 wherein the polymeric shell is selected from the group consisting of a poly(ether urea), a poly(ether urethane), a poly(ether amide), a poly(ether ester), or mixtures thereof.

38. A pressure fixable toner composition comprised of a core comprised of a pigment or dye; and a polymer core resin component selected from the group consisting of acrylate polymers, methacrylate polymers, styrene polymers, and dodecyl styrene polymers, which core is encapsulated within a shell comprised of the interfacial polycondensation reaction product of at least two polyisocyanates, one of which is a polyether-based polyisocyanate selected from the group consisting of polyether Vibrathanes, and polyether isocyanate prepolymers; a second polyisocyanate coreactant is selected from the group consisting of toluene diisocyanate, PAPI 27, PAPI 135, PAPI 94, PAPI 901, Isonate 143L, Isonate 181, Isonate 125M, Isonate 191, and Isonate 240; and a polyamine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylenediamine.

39. A toner in accordance with claim 38 wherein the pigment is carbon black, magnetites, or mixtures thereof.

40. A toner in accordance with claim 38 wherein the pigment is cyan, magenta, yellow, red, blue, green, brown, or mixtures thereof.

41. A toner composition in accordance with claim 40 wherein the shell material contains a polyurea, a polyester, a polyamide, a polyurethane, or mixtures thereof.

42. A toner in accordance with claim 38 wherein the monomer for the core resin binder is selected from the group consisting of butyl acrylate, butyl methacrylate, decyl methacrylate, lauryl acrylate, lauryl methacrylate, hexyl acrylate, hexyl methacrylate, propyl acrylate, propyl methacrylate, benzyl acrylate, benzyl methacrylate, pentyl acrylate, pentyl methacrylate, cyclohexyl acrylate, cyclohexyl methacrylate, ethoxypropyl acrylate, ethoxypropyl methacrylate, methoxybutyl acrylate, cyanobutyl acrylate, heptyl acrylate, heptyl methacrylate, methylbutyl acrylate, methylbutyl methacrylate, octyl acrylate, octyl methacrylate, ethylhexyl methacrylate, m-tolyl acrylate, dodecyl styrene, hexylmethyl styrene, nonyl styrene, tetradecyl styrene, and the copolymers thereof.

43. A method of imaging which comprises forming by ion deposition on an electroreceptor a latent image, subsequently developing this image with the toner composition of claim 38, and thereafter simultaneously transferring and fixing the image to a suitable substrate.

44. A method of imaging in accordance with claim 43 wherein there results images with excellent image fixing characteristics.

45. A toner composition in accordance with claim 38 wherein the shell material contains a polyurea, a polyester, a polyamide, a polyurethane, or mixtures thereof.

46. Encapsulated toner compositions comprised of a core comprised of resin binder, pigment, dye or mixtures thereof and a shell comprised of a polymer selected from the group consisting of a polyurea, a polyamide, a polyester, and mixtures thereof, each containing a polyether component.

47. Encapsulated toner compositions comprised of a core comprised of a resin binder, pigment and a shell comprised of a polymer selected from the group consisting of a polyurea, a polyamide, a polyester, and mixtures thereof, each containing a polyether component.

48. An encapsulated toner composition comprised of a core comprised of a resin binder, pigment, and a polymeric shell selected from the group consisting of a polyurea, a polyamide, and a polyester, each containing a polyether component.

* * * * *